US010912965B1

(12) United States Patent
Kalm

(10) Patent No.: US 10,912,965 B1
(45) Date of Patent: Feb. 9, 2021

(54) FIRE EXTINGUISHING SYSTEM

(71) Applicant: Amazon Technologies, Inc., Seattle, WA (US)

(72) Inventor: William Scott Kalm, Seattle, WA (US)

(73) Assignee: Amazon Technologies, Inc., Seattle, WA (US)

( * ) Notice: Subject to any disclaimer, the term of this patent is extended or adjusted under 35 U.S.C. 154(b) by 65 days.

(21) Appl. No.: 16/122,663

(22) Filed: Sep. 5, 2018

(51) Int. Cl.

| | |
|---|---|
| ***A62C 37/00*** | (2006.01) |
| ***A62C 37/36*** | (2006.01) |
| ***A62C 37/10*** | (2006.01) |
| *G08B 17/06* | (2006.01) |
| *A62C 37/48* | (2006.01) |

(52) U.S. Cl.
CPC ..... *A62C 37/04* (2013.01); *A62C 37/10* (2013.01); *A62C 37/48* (2013.01); *G08B 17/06* (2013.01)

(58) Field of Classification Search
CPC ..... A62C 37/00; A62C 37/04; A62C 37/08; A62C 37/10
See application file for complete search history.

(56) References Cited

U.S. PATENT DOCUMENTS

2008/0289834 A1* 11/2008 Edwards ..... A62C 13/64 169/60
2015/0324681 A1* 11/2015 Mats ..... G06K 19/07766 235/492
2019/0168037 A1* 6/2019 Lian ..... A62C 3/16

* cited by examiner

*Primary Examiner* — Curtis B Odom
(74) *Attorney, Agent, or Firm* — Patterson + Sheridan, LLP

(57) ABSTRACT

Techniques and safety devices are described for extinguishing fires within an inventory management system. A plurality of fire extinguishing devices for a plurality of containers in an inventory management system is monitored. Upon determining that a fire condition is occurring within the inventory management system, a positional information data store is queried to determine a current position of a first container within the inventory management system. Two or more containers within the inventory management system that are in close proximity to the first container are identified and one or more wireless signals are transmitted to two or more fire extinguishing devices of the plurality of fire extinguishing devices that are contained within the two or more containers, to activate the two or more first extinguishing devices. The plurality of containers is scanned using an infrared scanning device to determine whether all fire conditions within the inventory management system are extinguished.

11 Claims, 8 Drawing Sheets

FIRE EXTINGUISHING SYSTEM

BACKGROUND

The present invention relates to safety devices, and more specifically, to a first extinguishing device for containers that is configured to detect occurrences of fire conditions and to release a fire extinguishing material to extinguish such fire conditions.

Modern inventory systems, such as those in fulfillment centers, supply chain distribution centers, and custom-order manufacturing facilities, face significant challenges in responding to requests for inventory items. As inventory systems grow, the challenges of simultaneously completing many packing, storing, and other inventory-related tasks become non-trivial. Generally, inventory systems commonly employ shelving units to hold inventory items until they are needed to fulfill a customer order. The shelving units can be arranged (e.g., in rows that are spaced from one another) so as to define aisles (e.g., between the rows of shelving units). To store an inventory item on a desired shelving unit, a human or robotic carrying device can carry the inventory item down an aisle in the warehouse to the desired shelving unit and place the inventory item on the desired shelving unit where it is stored until it is needed. When an order is placed, a human or robotic carrying device can travel down the aisle to the desired shelving unit, retrieve the inventory item from the desired shelving unit, and place the inventory item on a conveyor belt that carries the inventory item downstream for packaging and shipping.

There are some systems in which containers are oriented in rows, and the entire row moves up or down vertically under the control of an operator or automatically through the use of a control logic. In such systems, a human can stand in a fixed location and a container can be brought to the user, who can then, for example, add an item to the container (or take an item from the container). The rows of containers can then be moved up or down, as appropriate, according to the fulfillment center workflow.

Although incredibly rare, adverse environmental conditions such as fires can occur within fulfillment center and other inventory system environments. As a result, these environments are typically equipped with numerous safety systems and procedures for managing these adverse environmental conditions. However, conventional safety systems (e.g., sprinkler devices, manually operated fire extinguishers and so on) can be unsuitable for many modern fulfillment center environments. For example, a sprinkler system could cause significant damage to products and robotic devices within a fulfillment center. Moreover, in many automated environments, many areas may be unreachable by humans during operation, and thus manually-operated fire extinguishers may be unusable in certain situations (e.g., where the fire occurs in a location that a human attempting to operate the fire extinguisher cannot reach).

DETAILED DESCRIPTION

Although highly uncommon, adverse environmental conditions such as fires can occur within fulfillment center environments. Conventionally, many physical environments have been equipped with sprinkler systems to contain damage from fires. Such systems may include piping and sprinkler heads that are located in, or suspended from, the ceiling of the physical environment. However, such sprinkler systems are ill-suited for use in many fulfillment centers and other inventory systems. For instance, automated systems and container storage locations may need to be engineered to support significantly more weight in the event a sprinkler system is installed, as such systems would need to be capable of bearing the weight of all of the containers filled with water. At best, such over-engineering could add substantial cost to the automated container management system, and at worst the design for the automated container management system simply may not be capable of bearing the increased weight of the water-filled containers.

Additionally, many automated fulfillment center environments contain a significant amount of automated equipment that can be easily damaged by water. Moreover, much of the product being stored in the containers managed by such automated equipment is frequently ruined in the event such sprinkler systems are activated. Such damage to automated equipment and product is amplified, as conventional sprinkler systems can distribute water beyond the area in which a fire is located. Thus, in many cases, some of the equipment and product lost in the event may be due to the water applied to areas beyond the location of the fire, rather than any fire itself.

As such, embodiments provide techniques and devices for extinguishing fires within inventory management systems. Generally, as described herein, an inventory management system refers to an automated system housing a plurality of containers and containing mechanisms for manipulating positions of the plurality of containers. For example, an inventory management system within a fulfillment center could manipulate containers storing items, according to a workflow to fulfill customer orders.

Figure 1:
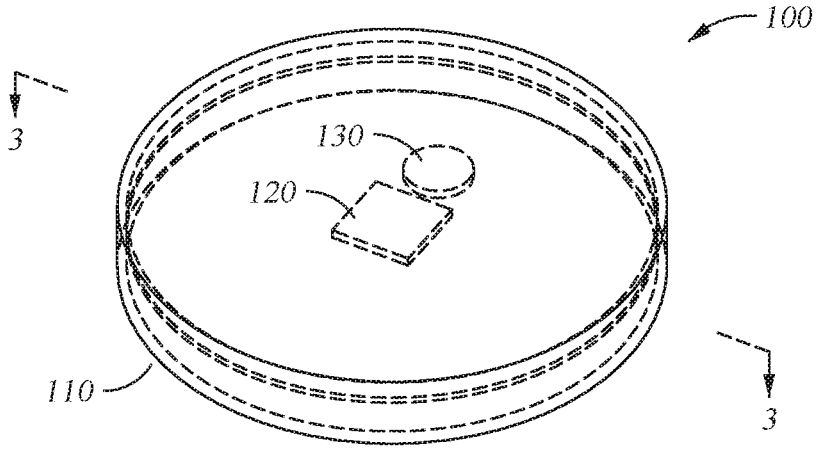
FIG. 1 is a diagram illustrating a structure of a fire extinguishing device for use with containers, according to one embodiment described herein.

One embodiment provides a substantially disc-shaped fire extinguishing device for use within containers in the inventory management system. FIG. 1 is a diagram illustrating a structure of such a fire extinguishing device for use with containers, according to one embodiment described herein. As shown, diagram 100 includes an outer shell 110 that encompasses various internal components of the fire extinguishing device. Generally, the outer shell 110 can house a number of components, including the power source 130 and the radio frequency identification (RFID) chip 120. Additionally, although not shown in the diagram 100, the outer shell 110 can house a fire extinguishing material, pyrotechnic material and a detonator. Generally, the detonator can be actuated to ignite the pyrotechnic material, bursting open the outer shell 110 and releasing the fire extinguishing material within the immediate physical environment. Preferably, the outer shell 110 is constructed from a material and has a thickness such that the outer shell 110 can be burst open by the ignition of pyrotechnic material housed within the outer shell 110.

Generally, the fire extinguishing material can be any material that, when released into the air, reacts in such a manner as to extinguish fires within the immediate physical area. For example, the fire extinguishing material could be an expansive foam that, when released, expands and fills the immediate physical area (e.g., a container), thereby extinguishing any fires in the immediate physical area. For example, the fire extinguishing material could include a foam concentrate material and water, and these materials, when mixed together with air, could form a homogeneous foam material. As another example, the fire extinguishing material could be a nanomaterial that, when released into the air, extinguishes any fires in the immediate physical area.

The RFID chip 120 can include a temperature sensor that is configured to collect sensor data associated with the ambient temperature within the fire extinguishing device and to write data values representing this sensor data to a memory bank within the RFID chip 120. The RFID chip 120 can generally be an active RFID chip (e.g., an RFID chip drawing power from the power source 130) or a passive RFID chip (e.g., an RFID chip without a dedicated power source). A remote RFID antenna can be used to read the data values from the memory bank of the RFID chip 120, thereby allowing a remote system to determine the ambient temperature within the fire extinguishing device.

The outer shell 110 can also house control logic that is configured to monitor the data values in the memory bank of the RFID chip 120 and, upon determining that the ambient temperature reading exceeds a predefined temperature threshold, to automatically initiate the detonator housed within the outer shell 110 to ignite the pyrotechnic material and to release the fire extinguishing material into the immediate physical environment. In one embodiment, a remote system is configured to periodically read the RFID chip 120 and, when the data values within the memory bank of the RFID chip 120 satisfy a predefined condition (e.g., the ambient temperature exceeding a predefined threshold temperature), the remote system can transmit one or more wireless signals to the control logic of the fire extinguishing device, instructing the control logic to actuate the detonator to release the fire extinguishing material. For example, such wireless signals could be transmitted using radio frequency (RF) communications, WiFi® communications, or more generally any suitable form of wireless communications can be used, consistent with the functionality described herein.

Figure 2:
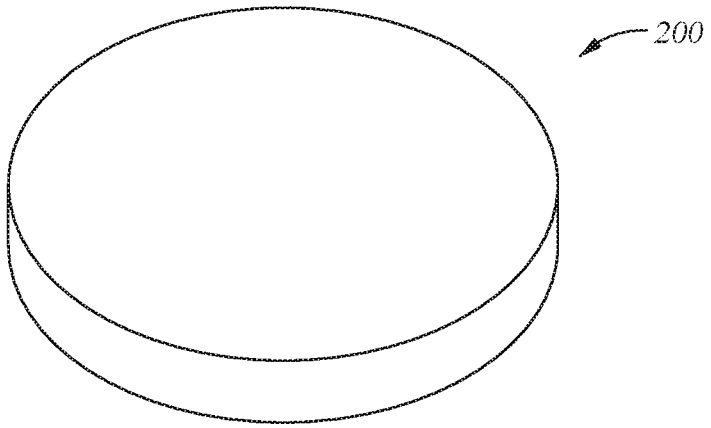
FIG. 2 is a plan view of a fire extinguishing device for use with containers, according to one embodiment described herein.

FIG. 2 is a plan view of a fire extinguishing device for use with containers, according to one embodiment described herein. In the depicted embodiment, the fire extinguishing device 200 is shown as a substantially cylindrical disc-shaped device. In one embodiment, the fire extinguishing device 200 is configured for use with containers that include a substantially cylindrical recessed area in one surface of the container. The fire extinguishing device 200 can then be removably coupled to the surface of the container, such that the fire extinguishing device 200 is housed within the recessed area.

In one embodiment, the outer shell 110 of the fire extinguishing device is composed of a rigid plastic material (e.g., acetal, polyacetal, etc.). As described herein, a variety of different materials may be suitable for construction of the outer shell 110. In one embodiment, rigid materials are preferable for use in the outer shell 110. The type of pyrotechnic used and the type of fire extinguishing material contained within the fire extinguishing device can also affect the choice of outer shell material. For example, some fire extinguishing materials could be contained under pressure within the fire extinguishing device, and thus an outer shell material that is strong enough to withstand the pressure may be preferable. More generally, any suitable material can be used for the outer shell 110, consistent with the functionality described herein.

Figure 3:
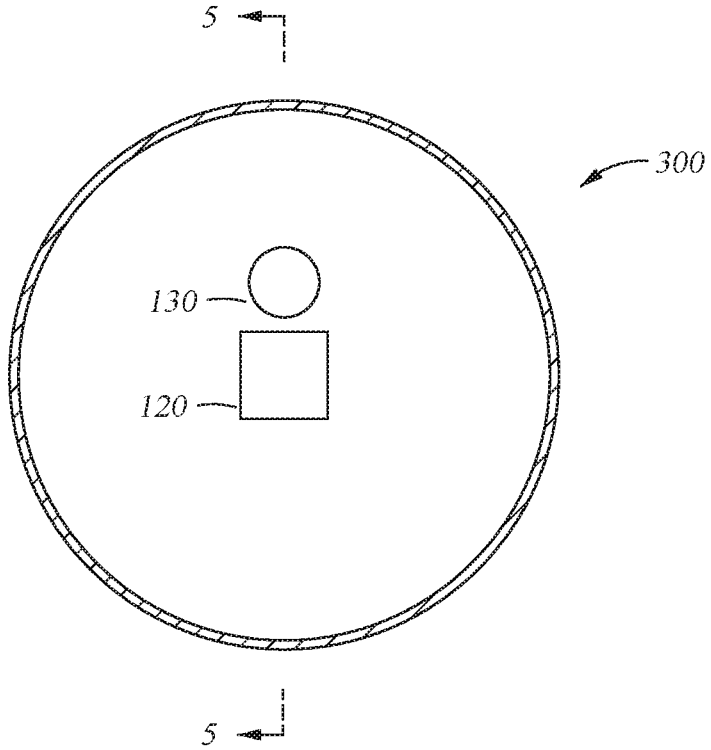
FIG. 3 is an overhead view of a fire extinguishing device for use with containers, according to one embodiment described herein.

FIG. 3 is an overhead view of a fire extinguishing device for use with containers, according to one embodiment described herein. As shown, the overhead view 300 depicts the placement of the power source 130 and RFID chip 120 within the fire extinguishing device 200. Of note, although the power source 130 and RFID chip 120 are housed within the outer shell of the fire extinguishing device 200 and thus may not be visible when viewing the fire extinguishing device (e.g., where the outer shell is made from an opaque material, such as a metal alloy or opaque plastic material), the positions of the power source 130 and RFID chip 120 are illustrated in the view 300 for illustrative purposes.

Figure 4:
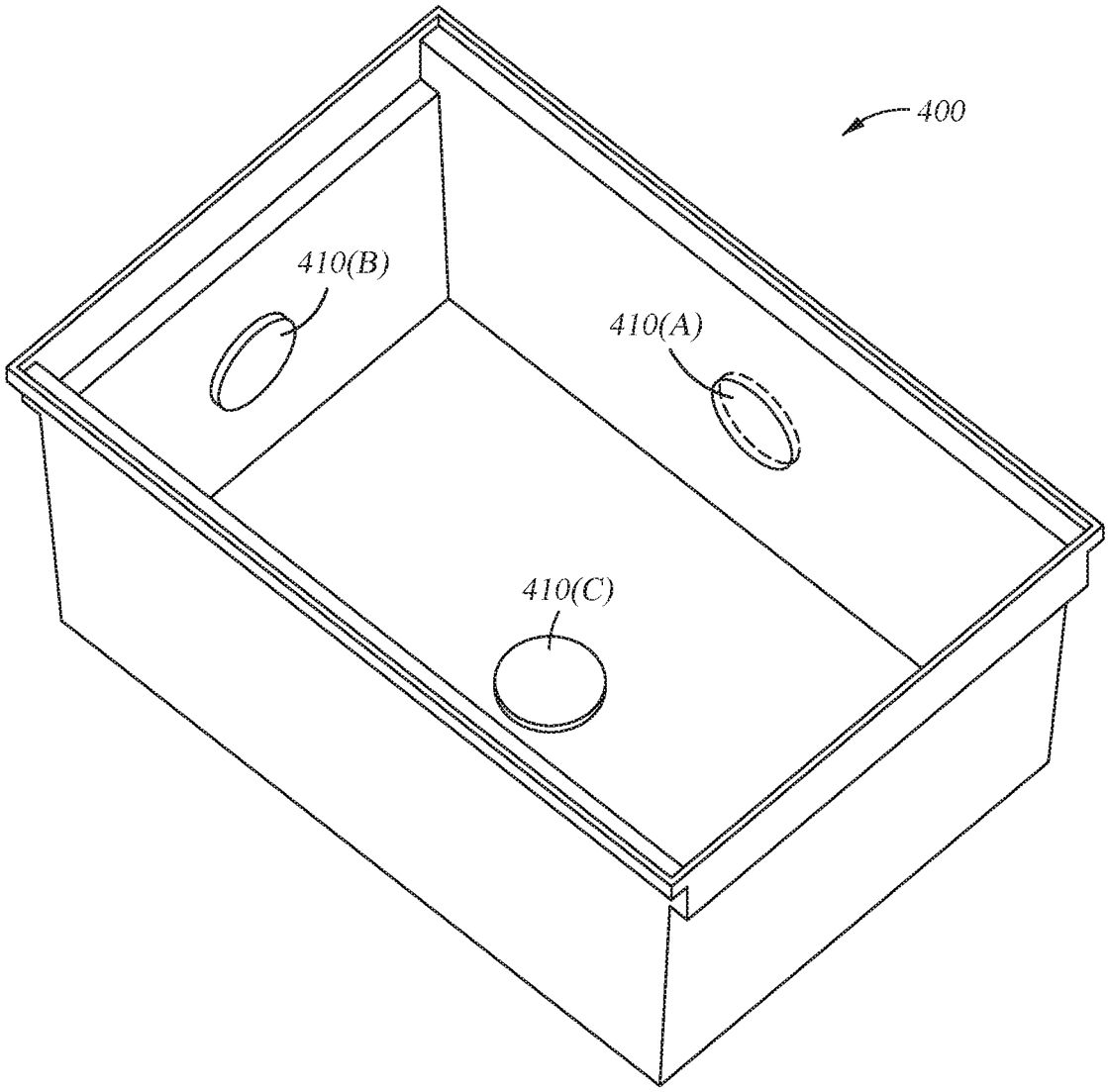
FIG. 4 illustrates potential placements for a fire extinguishing device within a container, according to one embodiment described herein.

FIG. 4 illustrates potential placements for a fire extinguishing device within a container, according to one embodiment described herein. As shown, the illustration 400 depicts a plurality of different placements 410(A)-(C) for a fire extinguishing device within a container. Of note, the placements 410(A)-(C) are depicted for illustrative purposes only and without limitation, and one of ordinary skill in the art will recognize that any number of different placements within a container can be used, consistent with the functionality described herein. In the depicted embodiment, the placements 410(A) and 410(B) are on the side walls of the container, while the placement 410(C) is on the floor surface of the container. Generally speaking, different placements within the container can be more or less optimal for a given implementation, depending on the container, the items commonly stored in the container, the inventory management system in which the container is being used, and so on. More generally, any placement where the fire extinguishing material within the fire extinguishing device can be released to extinguish fires within the immediate physical area can be used.

Of note, in one embodiment, where the containers are positioned vertically relative to one another within an inventory management system, the fire extinguishing device can be positioned on the exterior of the floor surface of the container, such that the fire extinguishing material within the fire extinguishing device is released above another container immediately below the container. In such an embodiment, fire extinguishing devices can be affixed to a non-container structures (e.g., a railing or other fixed structure) on a top portion of the inventory management system, for use in extinguishing fires in containers at the top of the inventory management system. That is, for containers that do not have another container positioned immediately above them, the fixed fire extinguishing device can be used to release fire extinguishing material onto the containers.

Additionally, although the illustration 400 shows multiple alternate placements 410(A)-(C) for fire extinguishing devices within a container, one embodiment herein includes two or more fire extinguishing devices within a single container. Such an embodiment may be preferable, for example, when the containers are larger in size and a single fire extinguishing device may not house enough fire extinguishing material to cover the entire container. As another example, when the containers may commonly store items that may impede the optimal release of one of the fire extinguishing devices, and thus multiple fire extinguishing devices could be used to ensure comprehensive coverage of the container.

Figure 5:
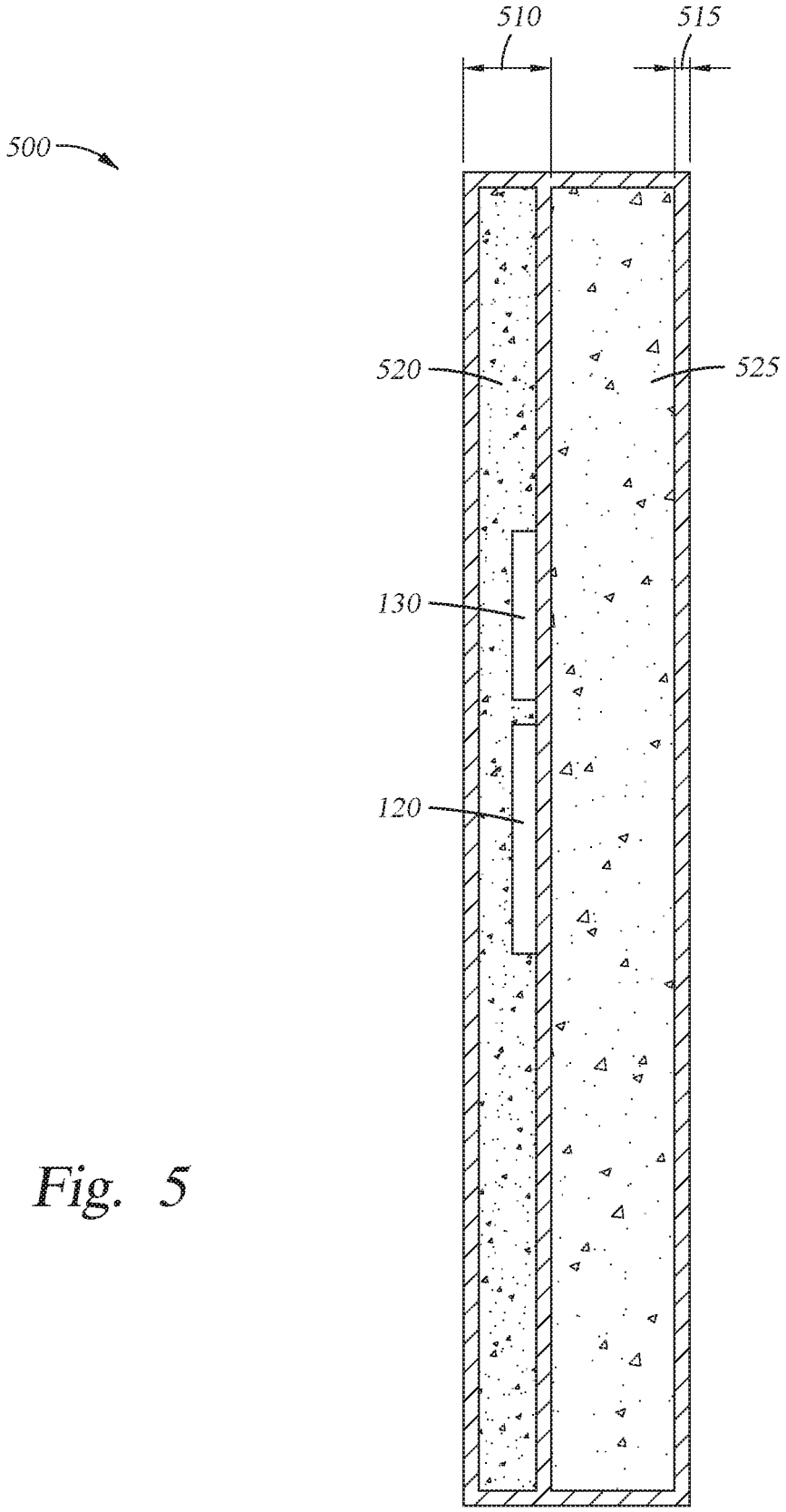
FIG. 5 illustrates a cross-sectional view of a fire extinguishing device for use with containers, according to one embodiment described herein.

FIG. 5 illustrates a cross-sectional view of a fire extinguishing device for use with containers, according to one embodiment described herein. As shown, the view 500 illustrates a pyrotechnic layer 520 and a fire extinguishing material layer 525, housed within an outer shell. Additionally, the fire extinguishing device includes the power source 130 and RFID chip 120 discussed above. In one embodiment, the width 510 of the pyrotechnic layer is approximately 0.1875 inches. More generally, however, the amount of space occupied by the pyrotechnic layer 520 can vary, depending on the type of pyrotechnic material used, the size of the fire extinguishing device, and the thickness of the outer shell. In a particular embodiment, the thickness 515 of the outer shell is approximately 0.03125 inches. More generally, however, the thickness 515 can vary depending on the material used to construct the outer shell, on the pyrotechnic material used, and so on.

Additionally, although not shown, the fire extinguishing device can house a detonator coupled to the power source 130 and configured to, when actuated, ignite the pyrotechnic material. Generally, the type and operation of the detonator can vary depending on the type of pyrotechnic material used in the pyrotechnic layer 520. The fire extinguishing device can also include control logic configured to automatically initiate the detonator, responsive to a predefined criteria being satisfied. For example, in one embodiment, the predefined criteria could comprise a temperature sensor within the fire extinguishing device reading a current temperature that exceeds a predefined threshold temperature. As another example, the predefined criteria could comprise receiving a particular wireless signal(s) from a remote device, instructing the control logic to actuate the detonator and to ignite the pyrotechnic material in the pyrotechnic layer 520.

As discussed above, the ignited pyrotechnic material can create an explosion that blows open the outer shell of the fire extinguishing device, thereby releasing the fire extinguishing material 525 into the immediate physical area. For example, where the fire extinguishing device is placed within a container of an inventory management system, the fire extinguishing material 525 can be released into the air within the container, thereby extinguishing any fires within the container. As discussed above, the fire extinguishing material can be any material that, when exposed to the air as a result of the pyrotechnic material being ignited, reacts in such a manner as to extinguish fires within the immediate physical area. For example, the fire extinguishing material could be an expansive foam that, when exposed to air, rapidly expands and extinguishes any fires in the immediate physical area. As another example, the fire extinguishing material could include a foam concentrate material and a liquid, and these materials, when mixed together with air, could form a foam material that extinguishes fires within the immediate physical area. As another example, the fire extinguishing material could be a nanomaterial that, when released into the air, extinguishes any fires in the immediate physical area.

In one embodiment, the power source 130 comprises a rechargeable power source. In such an embodiment, the fire extinguishing device may also include an induction coil coupled to the rechargeable power source. Such an induction coil, when in proximity to an inductive charging station, can be configured to receive energy by way of inductive coupling, and the received energy can be used to recharge the rechargeable power source. For example, an inductive charging station could be positioned at a fixed location within the inventory management system and can be used to recharge the power sources within fire extinguishing devices as the devices and their corresponding containers pass by the inductive charging station.

Figure 6:
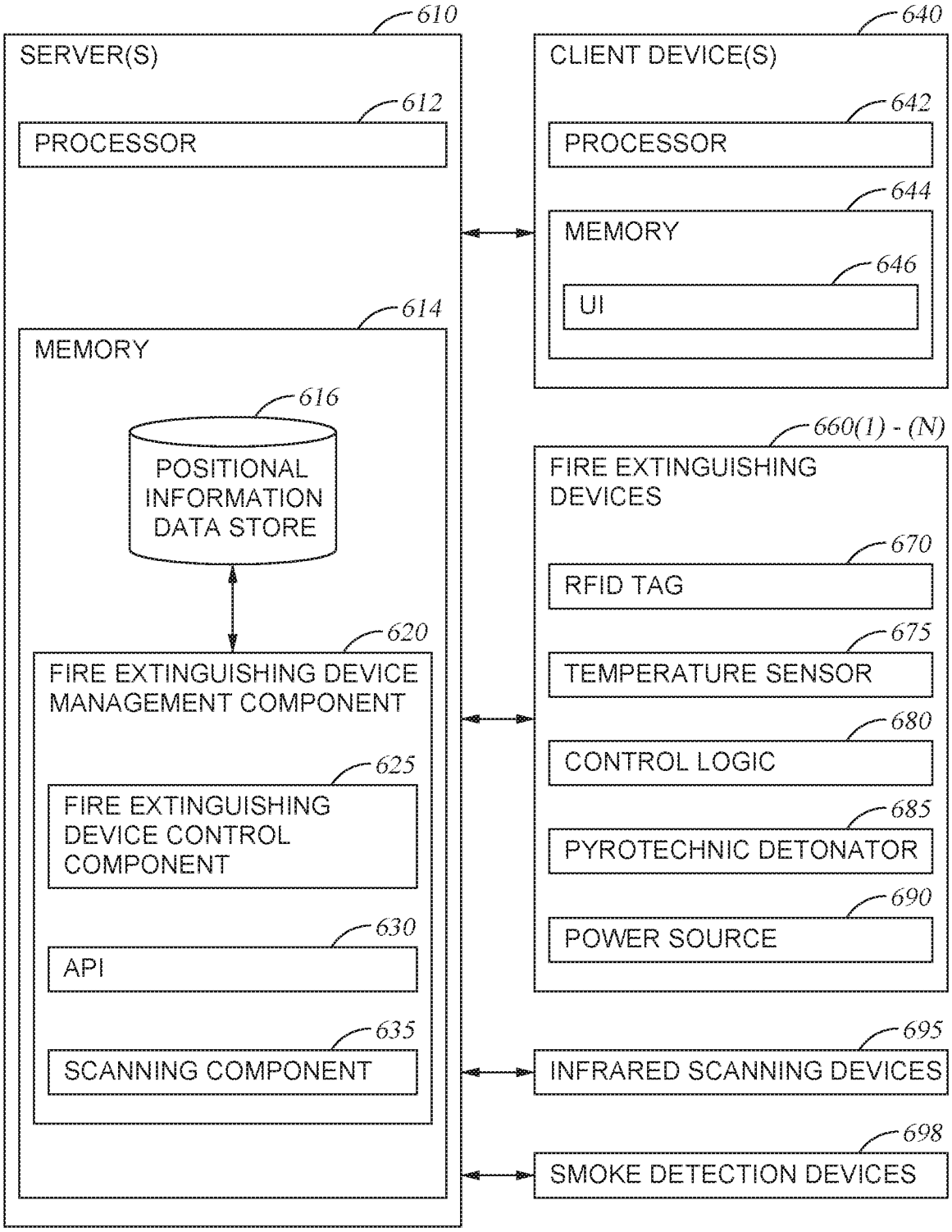
FIG. 6 illustrates a system for managing fire extinguishing devices for containers in an inventory system, according to one embodiment described herein.

FIG. 6 illustrates a system for managing fire extinguishing devices for containers in an inventory system, according to one embodiment described herein. As shown, the system 600 includes server(s) 610, client device(s) 640, fire extinguishing devices 660(1)-(N) infrared scanning devices 695 and smoke detection devices 698. The fire extinguishing devices 660(1)-(N) include an RFID tag 670, a temperature sensor 675, control logic 680, a pyrotechnic detonator 685 and a power source 690. Of note, although the server(s) 610, client device(s) 640, fire extinguishing devices 660(1)-(N) and infrared scanning devices 695 can be interconnected by one or more data communication networks, in various embodiments select components from the server(s) 610, client device(s) 640, fire extinguishing devices 660(1)-(N) and infrared scanning devices 695 may not be able to communicate directly with other components within the server(s) 610, client device(s) 640, fire extinguishing devices 660(1)-(N) and infrared scanning devices 695. For example, the infrared scanning devices 695 may be capable of communicating directly with the server(s) 610 via WiFi® communications, but may not be equipped with RF antennas to communicate with the RFID tags 670 of the fire extinguishing devices 660(1)-(N).

The server(s) 610 collectively provide processing capabilities 612 and memory 614. The memory 614 may include volatile and nonvolatile memory and/or removable and non-removable media implemented in any type or technology for storage of information, such as computer-readable instructions, data structures, program modules or other data. Such memory includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, RAID storage systems or any other medium which can be used to store the desired information and which can be accessed by a computing device.

Stored in the memory 614 is a positional information data store 616, which is communicatively coupled to a fire extinguishing device management component 620. The fire extinguishing device management component 620 includes a fire extinguishing device control component 625, an application program interface (API) 630 and a scanning component 635.

The client device(s) 640 has a processor 642 and memory 644 (e.g., volatile, nonvolatile, etc.), and may include input/output (I/O) devices (not shown) as well. A user interface (UI) 646 is stored in the memory 644 and executed on the processor 642 to allow the client device 640 to access the servers 610. For example, the UI 646 can be used to issue one or more calls to the API 630 provided by the fire extinguishing device management component 620. In one embodiment, the UI 646 could be provided by a web browser or other application that renders pages or content served by the servers 610. In one embodiment, the UI 646 represents an audio-based interface, where the user interacts with the UI 646 verbally (e.g., using a microphone device). Generally, the I/O devices can include any device capable of providing output to users of the device (e.g., a display device for outputting images, a speaker device for outputting sounds, etc.) as well as any devices through which a user can provide input (e.g., a touchscreen device, a mouse, a keyboard, etc.).

Generally, the fire extinguishing device management component 620 is configured to manage a plurality of fire extinguishing devices within an inventory management system. For example, the inventory management system can house and manipulate a plurality of containers, and each of the containers can be configured with a respective one or more fire extinguishing devices of the fire extinguishing devices 660(1)-(N). In one embodiment, the fire extinguishing device management component 620 is configured to monitor the fire extinguishing devices 660(1)-(N) for a plurality of containers in an inventory management system. For example, the temperature sensors 675 could collect temperature data relating to the ambient temperature within the fire extinguishing devices 660(1)-(N) and could write this temperature data to a memory bank of the corresponding RFID tag 670. The fire extinguishing device management component 620 could periodically read the RFID tags 670 within the fire extinguishing devices 660(1)-(N) to retrieve the temperature data. In one embodiment, where the RFID tag 670 comprises an active RFID tag, the RFID tag 670 could periodically broadcast the temperature data, and this data can be received by an antenna associated with the server(s) 610 and read by the fire extinguishing device management component 620.

In any event, the fire extinguishing device management component 620 could then determine whether the retrieved temperature data satisfies one or more predefined conditions, indicative of an occurrence of a fire condition. For example, the fire extinguishing device management component 620 could determine whether the temperature data indicates a temperature value in excess of a predefined threshold temperature. In one embodiment, upon determining that the one or more predefined conditions are satisfied, indicating an occurrence of a fire condition, the fire extinguishing device control component 625 could transmit a wireless signal(s) to the fire extinguishing device, instructing the control logic 680 to actuate the pyrotechnic detonator 685. Additionally, upon detecting an occurrence of a fire condition, the fire extinguishing device control component 625 could transmit an instruction to a controller for the inventory management system housing the containers containing the fire extinguishing devices 660(1)-(N), indicating that an adverse environmental condition has occurred. The controller for the inventory management system, in response, could stop all automated movement within the inventory management system and could generate a notification to a user. For example, such a notification could be transmitted to the client device(s) 640, for display in the UI 646.

In one embodiment, the control logic 680 is configured to monitor the temperature data read by the temperature sensor 675 and, when the temperature data satisfies a predefined condition (e.g., the temperature data indicates a temperature in excess of a predefined threshold temperature), the control logic 680 could automatically actuate the pyrotechnic detonator 685 to ignite the pyrotechnic layer within the fire extinguishing device, thereby detonating the outer shell of the fire extinguishing device and releasing the fire extinguishing material to extinguish any fires within the immediate physical area.

Upon determining that a fire condition has occurred at a first fire extinguishing device corresponding to a first container, the fire extinguishing device management component 620 could transmit instructions to the fire extinguishing device where the fire was detected, instructing the control logic 680 within the fire extinguishing device to actuate the pyrotechnic detonator 685 and to release the fire extinguishing material within the fire extinguishing device. For example, the fire extinguishing device management component 620 could transmit one or more instructions to write a predefined data value to a memory bank of the RFID tag of the fire extinguishing device. The control logic 680 within the fire extinguishing device could be configured to poll the memory bank and, upon detecting the predefined data value has been written to the memory bank, the control logic 680 within the fire extinguishing device could actuate the pyrotechnic detonator 685 and to release the fire extinguishing material within the fire extinguishing device. In one embodiment, the pyrotechnic detonator 685 comprises an electrical detonator device (e.g., an instantaneous electrical detonator, a short period delay detonator, etc.). In a particular embodiment, the pyrotechnic detonator 685 comprises two or more chemical compounds that, when mixed, create a reaction that detonates the pyrotechnic material within the fire extinguishing device. Such a pyrotechnic detonator 685 can also include a mechanism for, upon activation, mixing the two or more chemical compounds to create the reaction.

Of note, in one embodiment, the control logic 680 within the fire extinguishing devices 660(1)-(N) can monitor temperature data collected by the temperature sensors 675 and can automatically actuate the pyrotechnic detonator 685, without receiving explicit instructions from the fire extinguishing device management component 620 to do so.

In one embodiment, the fire extinguishing device management component 620 could periodically read the RFID tags within the fire extinguishing devices of the inventory management system and the fire extinguishing device management component 620 could determine when one of the RFID tags has stopped responding or otherwise cannot be read. Such a tag may be unavailable when, for example, the pyrotechnic material within the corresponding fire extinguishing device has been detonated, resulting in the RFID tag being damaged. However, such an RFID tag could also be unavailable when the RFID tag is experiencing a problem without any detonation having occurred. In one embodiment, upon determining that an RFID tag cannot be read, the fire extinguishing device management component 620 could determine the location of the corresponding container within the inventory management system (e.g., by querying a positional information data store with a unique identifier corresponding to the unresponsive RFID tag). The fire extinguishing device management component 620 could then activate one or more sensing devices (e.g., smoke detection devices 698, infrared scanning devices 695, etc.) determine whether any fire conditions are present in proximity to the determined location. In one embodiment, the fire extinguishing device management component 620 is configured to activate a subset of available sensing devices that correspond to the determined location, rather than activating all of the available sensing devices. The fire extinguishing device management component 620 could then determine whether a fire condition has occurred, based on data received from the activated sensing devices and, if so, the fire extinguishing device management component 620 could activate one or more fire extinguishing devices in proximity to the determined location.

Additionally, the fire extinguishing device management component 620 could query a positional information data store for the inventory management system to determine a current position of the first container within the inventory management system. The fire extinguishing device management component 620 could query the positional information data store 616 to determine the first container's current position within the inventory management system. That is, the inventory management system may manipulate the positions of the various containers as directed by the business workflow, and the current positions of the individual containers can be maintained in the positional information data store 616. For example, each container could be assigned a unique identifier, and the fire extinguishing devices 660(1)-(N) can be assigned corresponding unique identifiers. For example, such unique identifiers could be stored in a memory bank of the RFID tag 670 (e.g., together with, or separate from, the temperature data collected by the temperature sensor 675). The fire extinguishing device management component 620 could read the unique identifier by scanning the RFID tag 670 with an RFID antenna, and could query the positional information data store 616 using the unique identifier to determine the corresponding container's current position.

The fire extinguishing device management component 620 could further determine two or more containers within the inventory management system that are in close proximity to the first container. Generally, "close proximity" is defined by preconfigured information, and such information could be, for example, hard coded within the fire extinguishing device management component 620 or user-configurable. For example, a user could specify that, for a particular inventory management system, the fire extinguishing devices within all immediately adjacent containers to the container where the fire was detected should be detonated. As another example, the scanning component 635 could be configured to generate one or more infrared images of the inventory management system using the infrared scanning devices, and to determine which additional fire extinguishing devices 660(1)-(N) to detonate based on the infrared images. For example, if the infrared images indicate a very small heat signature for the fire within the inventory management system, the fire extinguishing device management component 620 could determine to detonate only the immediately adjacent fire extinguishing devices. On the other hand, if the infrared images indicate that the fire is burning at a very high temperature or expanding rapidly, the fire extinguishing device management component 620 could determine to detonate a significant number of fire extinguishing devices 660(1)-(N) surrounding the container where the fire was initially detected. More generally, any suitable control logic could be used by the fire extinguishing device management component 620 in determining the two or more containers that are in close proximity to the first container, consistent with the functionality described herein.

In one embodiment, the fire extinguishing device management component 620 could query the positional information data store 616 using the current position of the first container to determine the two or more containers in close proximity to the first container. The fire extinguishing device control component 625 could then transmit one or more wireless signals to two or more fire extinguishing devices of the plurality of fire extinguishing devices that are contained within the two or more containers, to activate the two or more first extinguishing devices. That is, upon receiving the wireless signals, the control logic 680 for the two or more fire extinguishing devices could actuate the pyrotechnic detonator 685, thereby igniting the pyrotechnic material within the two or more fire extinguishing devices. By doing so, the fire extinguishing device management component 620 can help proactively contain any fires by releasing the fire extinguishing material not only within the container where the first was detected, but within the surrounding containers in case the fire had started to spread.

The scanning component 635 could then activate one or more infrared scanning devices 695 to scan the plurality of containers using an infrared scanning device to determine whether all fire conditions within the inventory management system are extinguished. For example, the infrared scanning devices 695 could include infrared photography (IR) and infrared reflectography (IRR) scanning devices that are configured to generate an infrared image(s) of the inventory management system. The fire extinguishing device control component 625 could then analyze the generated infrared image(s) to determine whether any fires remain within the inventory management system. Additionally, the scanning component 635 could activate one or more of the smoke detection devices 698 to determine whether any fire remains within the inventory management system. If the fire extinguishing device control component 625 determines a fire still exists within the inventory management system, the fire extinguishing device control component 625 could correlate the portion of the infrared image indicative of a fire (e.g., a portion of the image indicative of a temperature above a predefined threshold temperature) with one or more containers, based on predefined positional information indicating the fixed positions of the infrared scanning devices 695 and by querying the positional information data store 616. The fire extinguishing device control component 625 could then transmit wireless signals to the fire extinguishing devices in proximity to the remaining fire, in order to detonate the fire extinguishing devices and extinguish the remaining fire.

Figure 7:
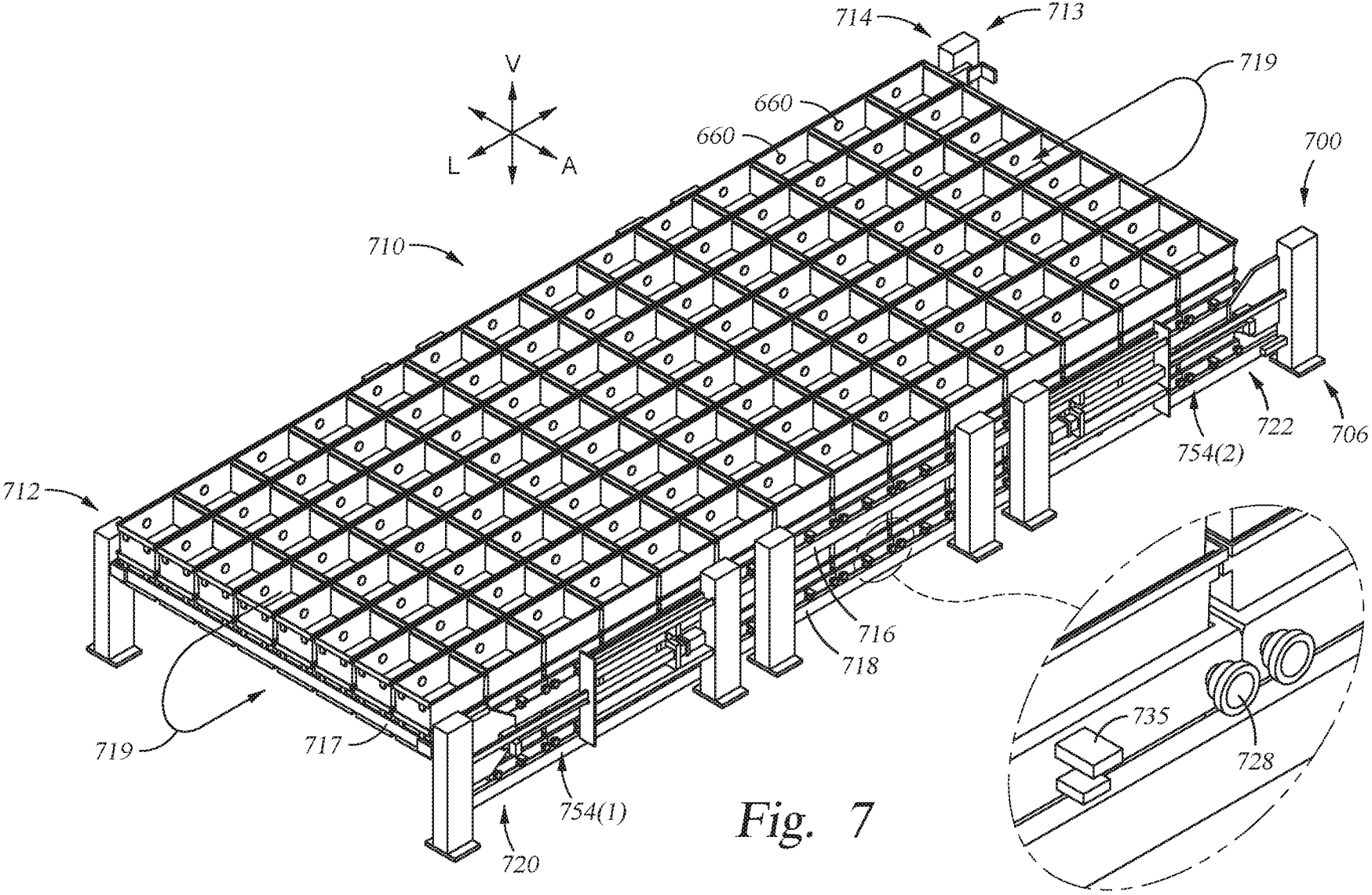
FIG. 7 shows a perspective view of an inventory system having a plurality of container carriers, each supporting a plurality of inventory storage containers, according to one embodiment described herein.

FIG. 7 shows a perspective view of an inventory management system having a plurality of container carriers, each supporting a plurality of inventory storage containers, according to one embodiment described herein. In general, the storage module 710 has a first end 712, a second end 714, a first side 711, and a second side 713. Further, the storage module 710 has first to fourth conveyor segments 716, 718, 720, and 722. In this embodiment, the first and second conveyor segments 716 and 718 are offset from one another along a vertical direction. Thus, the first and second conveyor segments 716 and 718 can be referred to as upper and lower conveyor segments, respectively. The upper and lower conveyor segments 716 and 718 are configured to transfer container carriers 717 along a longitudinal direction L, each container carrier configured to support at least one storage container 715. The third and fourth conveyor segments 720 and 722 are implemented as first and second vertical lifts 760(1) and 760(2), respectively. Each vertical lift 760(1) and 760(2) is configured to transfer the container carriers 717 between the upper and lower conveyor segments 716 and 718. The storage module 710 can be configured such that, when the vertical lifts 760(1) and 760(2) transfer container carriers 717, at least some, up to all, of the container carriers 717 on the upper and lower conveyor segments 716 and 718 remain stationary. The storage module 710 can be configured such that, when the container carriers 717 are moved along the upper and lower conveyor segments 716 and 718, the vertical lifts 760(1) and 760(2) do not move any container carriers 717.

The conveyor segments 716, 718, 720, and 722 together define a movement path 719 having a closed shape, and the storage module 710 is configured to transfer the container carriers 717 around the movement path 719. In this embodiment, the movement path 719 has a rectangular shape, although it will be understood that the movement path 719 can have any other suitable closed shape. The movement path 719 can be elongate along the longitudinal direction L. Thus, the movement path 719 can have a length along the longitudinal direction L that is greater than a height of the movement path along the vertical direction V.

The storage module 710 can include at least one controller configured to provide at least one control signal to the vertical lifts 760(1) and 760(2) and to at least one movement system so as to control the movement of the container carriers 717 around the movement path 719. In some embodiments, the controller can control the speed in which the container carriers 717 are moved. Further, in some embodiments, the controller 724 can control the direction in which the container carriers 717 are moved. Yet further, in some embodiments, the controller can stop the vertical lifts 760(1) and 760(2) and at least one movement system when a desired one of the container carriers 717 is presented at one of the first end 712 and the second end 714.

The storage containers 715 in the storage module 710 can be densely packed along the vertical direction V. In particular, the storage containers 715 on the upper conveyor segment 716 can be stacked above the storage containers 715 on the lower conveyor segment 718 so that the space between each storage container 715 on the bottom level and the first conveyor segment 716 can be minimized to maximize storage density. In some examples, this spacing can be described by absolute distance, such as a distance ranging from 0.25 to 1.25 inches, such as 0.50 to 1.00 inches. In other examples, this spacing can be described in relation to a height of one of the storage containers, such as a spacing that is no more than 20 percent of the height of the storage containers, such as no more than 15 percent of the height of the storage containers, such as no more than 10 percent of the height of the storage containers, or such as no more than 5 percent of the height of the storage containers. Storage density is inversely proportional to the distance between a storage container and the conveyor segment 16 immediate over top of the storage container. Thus, as this distance is decreased, the storage density increases.

Referring now more specifically to the details of the storage module 710, the upper and lower conveyor segments 716 and 718 include tracks configured to support the container carriers 717, and the container carriers 717 are configured to move along the tracks. Each of the tracks of the upper and lower conveyor segments 716 and 718 are elongate along the longitudinal direction L. Each of the tracks of the upper and lower conveyor segments 716 and 718 can include an upper track surface 746 that is configured to support wheels of the container carriers 717.

Each container carrier 717 is configured to support a row of inventory storage containers 715 such that the storage containers 715 are offset from one another along the lateral direction A. For example, each container carrier 717 can be configured to support the storage containers 715 in a side-by-side relation such that the opposed sidewalls 715*a* and 715*b* of each storage container 715 are spaced from one another along the lateral direction A and at least one sidewall 715*a* or 715*b* of each storage container 715 faces a sidewall 715*a* or 715*b* of one another one of the storage containers 715 along the lateral direction A. In alternative embodiments (not shown), each container carrier 717 can be configured to support the storage containers 715 in an end-to-end relation such that the opposed end walls 715*c* and 715*d* of each storage container 715 are spaced from one another along the lateral direction A and at least one end wall 715*c* or 715*d* of each storage container 715 faces an end wall 715*c* or 715*d* of one another one of the storage containers 715 along the lateral direction A. Each container carrier 717 can also be configured to support the storage containers 715 in a stacked relation, such that each of one or more containers 715 of the first row has a container stacked thereon. Thus, each container carrier can be configured to support the first row of storage containers 715 and at least a second row of storage containers 715 stacked on the first row.

Figure 8:
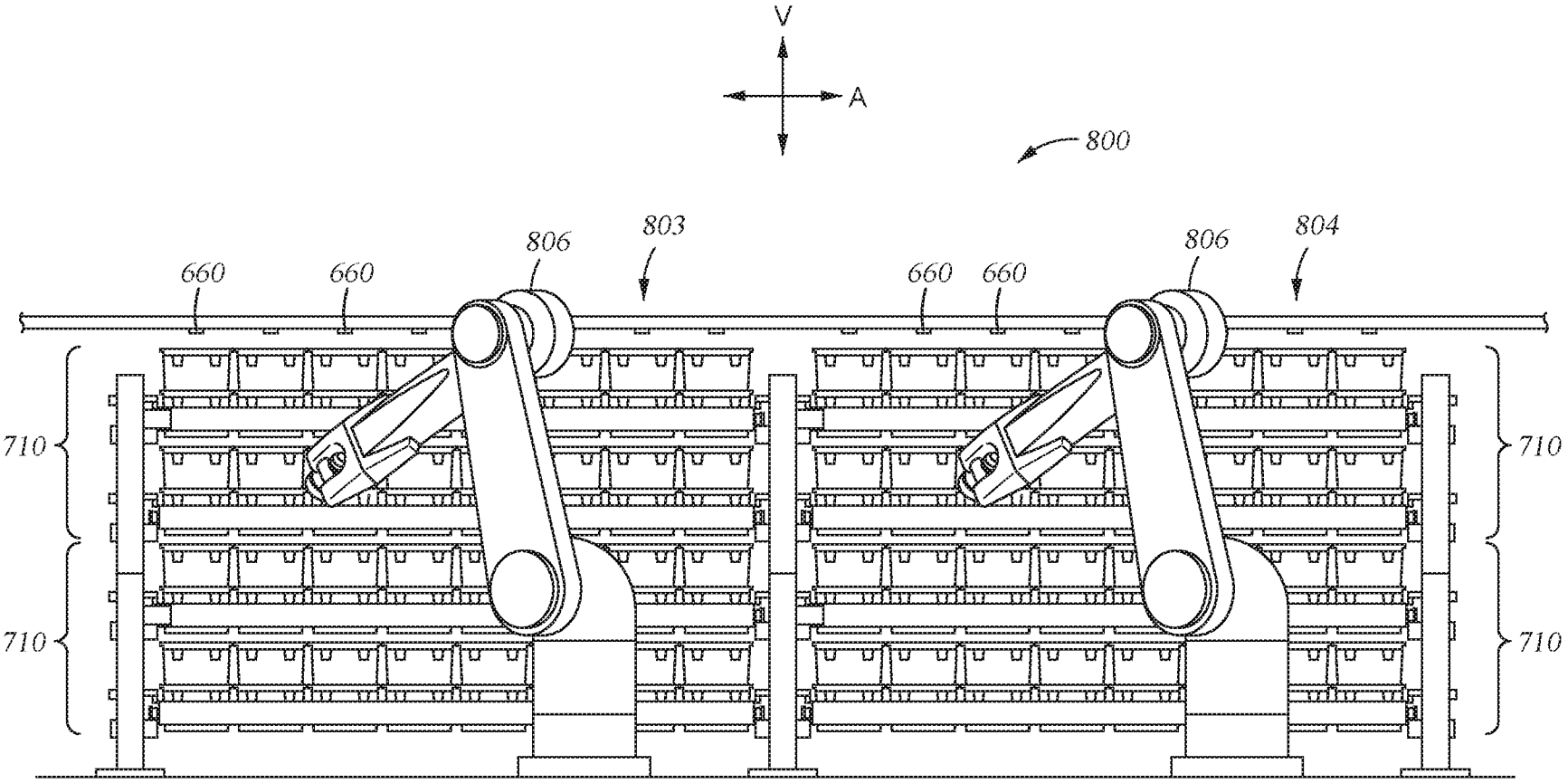
FIG. 8 shows a side view of a modular inventory management system that comprises a plurality of storage module instances and a plurality of container carriers, according to one embodiment described herein.

FIG. 8 shows a side view of a modular inventory management system that comprises a plurality of instances of the storage module 710 of FIG. 7 each supporting a plurality of storage containers 715, according to one embodiment described herein. The system 800, and more generally inventory management systems described herein, can include at least one vertical stack of storage modules that comprises at least two of the storage modules stacked on top of one another along the vertical direction V. In at least some embodiments, the system 800 can include the storage containers 715 supported by the system, although it will be understood that the system can be made and sold without the storage containers 715.

As shown, the system 800 includes a plurality of instances of the storage module 710, each extending from a first system end to a second system end. The plurality of storage modules 710 includes a first vertical stack 803 of the storage modules 710 that comprises a plurality (e.g., at least two) of the storage modules 710 stacked on top of one another along the vertical direction V. The storage system 800 further includes a second vertical stack 804 of the storage modules 710 that comprises a plurality (e.g., at least two) of the storage modules 710 stacked on top of one another along the vertical direction V. The second vertical stack 804 can be offset from the first vertical stack 803 along the lateral direction A.

Each storage module 710 of the system 800 can be independently operated such that storage containers 715 of each storage module 710 can be driven around their corresponding movement path independently of the storage containers 715 of other storage modules 710 being driven around their corresponding movement path. Although two vertical stacks 803 and 804, each having two storage modules 710 are shown, it will be understood that the number of vertical stacks and the number of storage modules 710 in each vertical stack can vary from that shown. In particular, modular storage and retrieval systems of the disclosure can include at least one vertical stack of storage modules 710 or more than one vertical stack of storage modules 710. Further, each vertical stack of storage modules 710 can have at least two storage modules 710 stacked on top of one another or more than two storage modules 710. Thus, height, width, and length of the system 800 can be scalable to fit within a desired volume in a warehouse space.

The storage modules 710 can be stacked on top of one another so that the space between the storage containers 715 of each storage module 710 and a storage module 710 immediately over top of the storage module 710 can be minimized to maximize storage density. In some examples, this spacing can be described by absolute distance, such as a distance ranging from 0.25 to 1.25 inches, such as 0.50 to 1.00 inches. In other examples, this spacing can be described in relation to a height of one of the storage containers 715, such as a spacing that is no more than 20 percent of the height of the storage container 15, such as no more than 15 percent of the height of the storage container 15, such as no more than 10 percent of the height of the storage container 15, or such as no more than 5 percent of the height of the storage container 15. Storage density is inversely proportional to the distance between the storage containers 715 of vertically adjacent storage modules 710. Thus, as this distance is decreased, the storage density increases.

The modular storage and retrieval system 800 can also include at least one robotic manipulator 806 and at least one controller 24 that can be implemented as described above. For example, the system 800 can include at least one robotic manipulator 806 that services the first system end of each storage module 710 in a vertical stack. The system 800 can additionally or alternatively include at least one robotic manipulator 806 that services the second system end 14 of each vertical stack of storage modules 710 as shown. In some embodiments, the manipulators 806 at the first system end 91 can be used to stow inventory items or storage containers 715 in the storage modules 710, and the manipulators 806 at the second system end can be used to retrieve inventory items or storage containers 715 from the storage modules 710. Alternative embodiments can include at least manipulator 806 on only one end of a vertical stack, the at least one manipulator 806 configured to perform both stowing and retrieving operations. Additionally or alternatively, one or more of the robotic manipulators 806 can service multiple vertical stacks of storage modules 710. Although not shown, in some embodiments, the at least one robotic manipulator 806 can be configured to move vertically and/or horizontally to service the storage modules 710 of the system 800. For example, a robotic manipulator 806 can be mounted on a horizontal and/or vertical track to enable it to move with respect to the vertical stacks.

Figure 9:
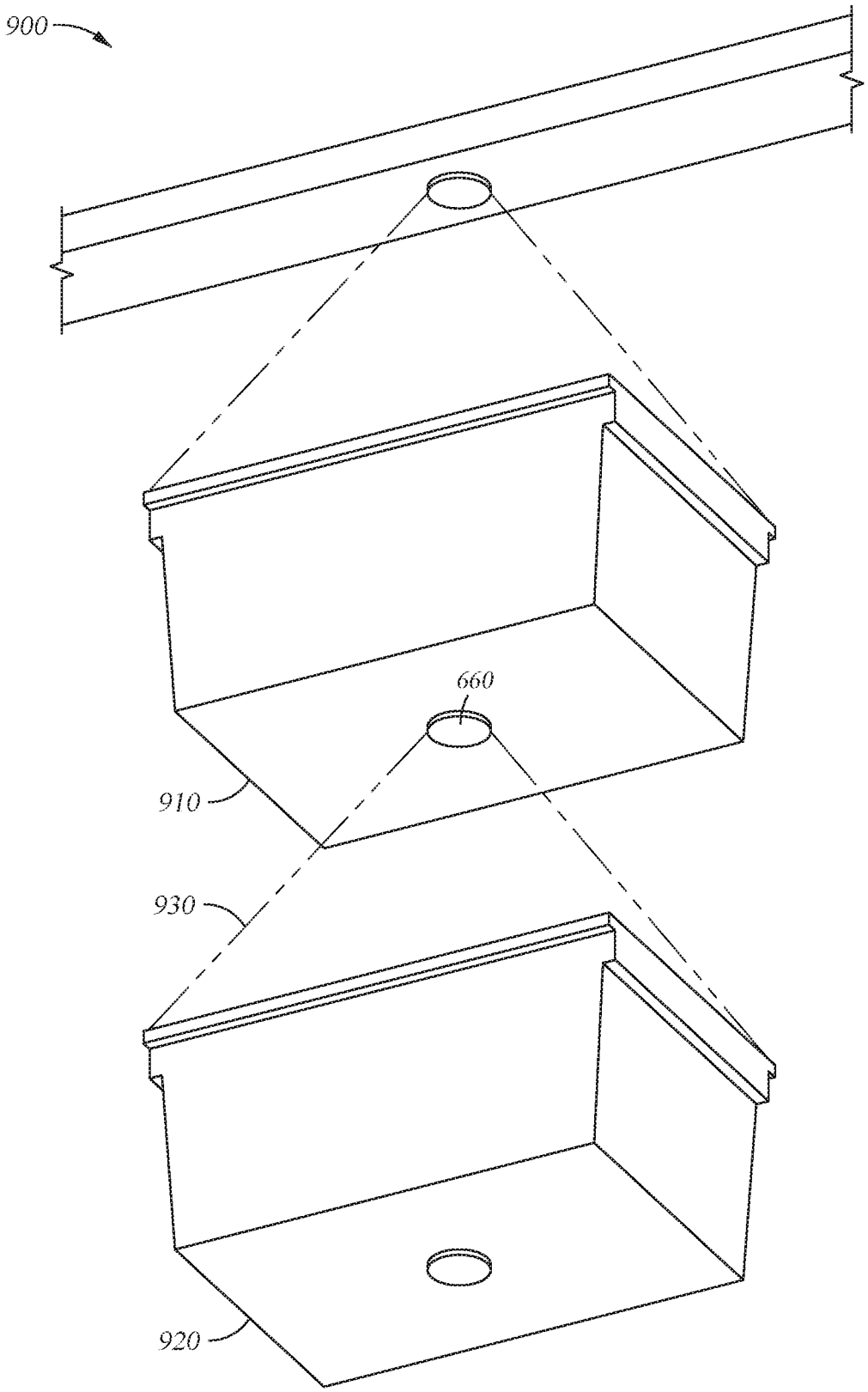
FIG. 9 is a plan view of a fire extinguishing device placed underneath a container, according to one embodiment described herein.

FIG. 9 is a plan view of a fire extinguishing device placed underneath a container, according to one embodiment described herein. As shown, the system 900 illustrates a first container 910 that is currently positioned above a second container 920 within an inventory management system. In the depicted embodiment, the container 910 is configured with a fire extinguishing device 660 that is placed underneath the container 910 and on the exterior surface of the container 910. In the depicted embodiment, the fire extinguishing device 660 can be activated in order to extinguish a fire occurring in the container 920, as the fire extinguishing material within the fire extinguishing device 660 will be dispersed above the container 920, as shown by the dotted lines 930.

Accordingly, the fire extinguishing device management component 620 can be configured to consider such an arrangement of fire extinguishing devices 660. For example, after determining that a fire condition is occurring within a first container and determining two or more containers within the inventory management system that are in close proximity to the first container, the fire extinguishing device management component 620 could further determine a second two or more containers that are positioned immediately above the determined two or more containers. The fire extinguishing device management component 620 could then transmit one or more wireless signals to two or more fire extinguishing devices of the plurality of fire extinguishing devices that are contained on the exterior underside of the second two or more containers, to activate the two or more first extinguishing devices and to disperse their fire extinguishing material down onto the determined two or more containers.

Figure 10:
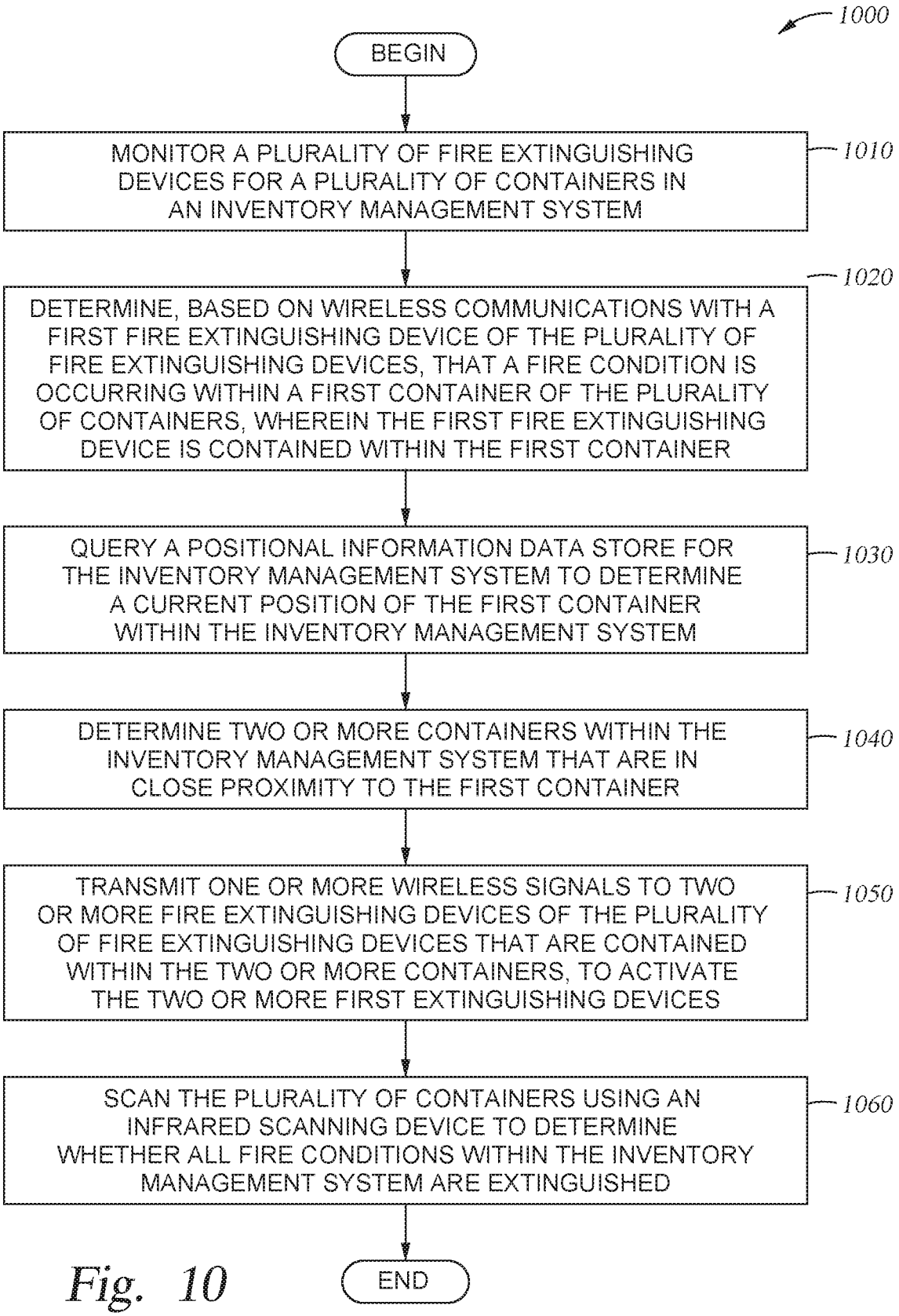
FIG. 10 is a flow diagram illustrating a method of extinguishing a fire within an inventory system through the use of a plurality of fire extinguishing devices, according to one embodiment described herein.

FIG. 10 is a flow diagram illustrating a method of extinguishing a fire within an inventory system through the use of a plurality of fire extinguishing devices, according to one embodiment described herein. As shown, the method 1000 begins at block 1010, where the fire extinguishing device management component 620 monitors a plurality of fire extinguishing devices for a plurality of containers in an inventory management system. The fire extinguishing device management component 620 determines, based on wireless communications with a first fire extinguishing device of the plurality of fire extinguishing devices, that a fire condition is occurring within a first container of the plurality of containers, wherein the first fire extinguishing device is contained within the first container (block 1020).

The fire extinguishing device management component 620 queries the positional information data store 616 for the inventory management system to determine a current position of the first container within the inventory management system (block 1030). The fire extinguishing device management component 620 determines two or more containers within the inventory management system that are in close proximity to the first container (block 1040). The fire extinguishing device control component 625 transmits one or more wireless signals to two or more fire extinguishing devices of the plurality of fire extinguishing devices that are contained within the two or more containers, to activate the two or more first extinguishing devices. The scanning component 635 scans the plurality of containers using an infrared scanning device 695 to determine whether all fire conditions within the inventory management system are extinguished (block 1050), and the method 1000 ends.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

In the preceding, reference is made to embodiments presented in this disclosure. However, the scope of the present disclosure is not limited to specific described embodiments. Instead, any combination of the features and elements described herein, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the aspects, features, embodiments and advantages described herein are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Aspects of the present invention may take the form of an entirely hardware embodiment, an entirely software embodiment (including firmware, resident software, micro-code, etc.) or an embodiment combining software and hardware aspects that may all generally be referred to herein as a "circuit," "module" or "system."

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the FIGS. illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the FIGS. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

While the foregoing is directed to embodiments of the present invention, other and further embodiments of the invention may be devised without departing from the basic scope thereof, and the scope thereof is determined by the claims that follow.

What is claimed is:

1. A fire extinguishing device, further comprising:

a first portion containing:

a temperature sensor configured to read a current temperature within the fire extinguishing device and to write a temperature value to a memory bank;

a detonator coupled to a rechargeable power source;

control logic configured to automatically initiate the detonator, responsive to the temperature sensor reading a current temperature that exceeds a predefined threshold temperature; and a pyrotechnic layer, wherein the detonator, when initiated, is configured to ignite the pyrotechnic layer;

a second portion containing a fire extinguishing material that, when released from within the fire extinguishing device, is configured to extinguish fire within an immediate physical area; and an outer shell surrounding the first portion and the second portion, wherein the pyrotechnic layer, when ignited, is configured to burst the outer shell, releasing the fire extinguishing material.

2. The fire extinguishing device of claim 1, wherein the outer shell is a disc shaped enclosure, and wherein the fire extinguishing device further comprises a radio-frequency identification (RFID) tag.

3. The fire extinguishing device of claim 1, wherein the fire extinguishing material further comprises at least one of a fire extinguishing nano-particle material or a fire extinguishing expansive material.

4. The fire extinguishing device of claim 1, further comprising:

the rechargeable power source; and an induction coil coupled to the rechargeable power source, wherein the induction coil, when in proximity to an inductive charging station, is configured to receive energy by way of inductive coupling, wherein the received energy is used to recharge the rechargeable power source.

5. The fire extinguishing device of claim 1, further comprising:

a wireless transceiver; and control logic configured to receive instructions over the wireless transceiver and, upon receiving a first instruction, to initiate the detonator to ignite the pyrotechnic layer.

6. The fire extinguishing device of claim 5, wherein the wireless transceiver further comprises an active RFID tag.

7. A container comprising a plurality of sides, wherein the plurality of sides are arranged to support at least one inventory item therein, wherein a first side of the plurality of sides comprises a recessed area configured to house a fire extinguishing device, wherein the fire extinguishing device comprises:

a first portion comprising a fire extinguishing material that, when released from within the fire extinguishing device, is configured to extinguish fire within an immediate physical area;

a second portion comprising:

a pyrotechnic layer configured to, when ignited, release the fire extinguishing material;

a detonator that, when actuated, is configured to ignite the pyrotechnic layer; and control logic configured to actuate the detonator, responsive to a predefined criteria being satisfied; and an outer shell at least partially surrounding the first portion and the second portion, wherein the pyrotechnic layer, when ignited, is configured to burst the outer shell, releasing the fire extinguishing material.

8. The container of claim 7, wherein the fire extinguishing device further comprises:

a radio-frequency identification (RFID) tag; and a temperature sensor configured to read a current temperature and to write a temperature value to a memory bank of the RFID tag, wherein the predefined criteria further comprises the control logic determining that the temperature sensor is currently reading a current temperature that exceeds a predefined threshold temperature.

9. The container of claim 7, wherein the predefined criteria further comprises receiving a command, over a wireless data communications network, instructing the control logic to actuate the detonator.

10. The container of claim 7, wherein the fire extinguishing device is removably coupled to the first side of the container, wherein the fire extinguishing device and the recessed area are substantially cylindrical in shape, and wherein the fire extinguishing device further comprises:

a rechargeable battery coupled to the detonator; and an induction coil coupled to the rechargeable battery, wherein the induction coil, when in proximity to an inductive charging station, is configured to receive energy by way of inductive coupling, wherein the received energy is used to recharge the rechargeable battery.

11. The container of claim 7, wherein the fire extinguishing material further comprises at least one of a fire extinguishing nano-particle material or a fire extinguishing expansive material.

* * * * *